US006259878B1

(12) United States Patent
Sato et al.

(10) Patent No.: US 6,259,878 B1
(45) Date of Patent: Jul. 10, 2001

(54) ONE-COMPONENT DEVELOPER REGULATING MEMBER FOR ELECTRO PHOTOGRAPHIC DEVICE

(75) Inventors: Kunihiko Sato; Masatoshi Kimura, both of Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/546,179

(22) Filed: Apr. 10, 2000

(30) Foreign Application Priority Data

Sep. 6, 1999 (JP) ..... 11-251845

(51) Int. Cl.[7] ..... G03G 15/08
(52) U.S. Cl. ..... 399/284
(58) Field of Search ..... 399/268, 273, 399/274, 283, 284

(56) References Cited

U.S. PATENT DOCUMENTS 5,495,321 * 2/1996 Sunaga et al. ..... 399/273
5,729,806 * 3/1998 Niwano et al. ..... 399/284
5,937,253 * 8/1999 Shimazaki et al. ..... 399/284
6,026,265 * 2/2000 Kinoshita et al. ..... 399/283 X
6,094,555 * 7/2000 Katoh et al. ..... 399/284

* cited by examiner

*Primary Examiner*—Susan S. Y. Lee
(74) *Attorney, Agent, or Firm*—Armstrong, Westerman, Hattori, McLeland & Naughton, LLP

(57) ABSTRACT

A one-component developing device which develops electrostatic latent images using a one-component developer, and which prevents image density changes and the occurrence of lines and stripes. A blade is supported at both ends by a blade table and since face-contact is achieved with a developer carrier, pressure is dispersed, and the solidification and the attachment of the developer to the developer carrier and the blade can be prevented. In addition, since pressure exerted by stored developer does not affect the blade, changes in the image density can be prevented.

9 Claims, 7 Drawing Sheets

ONE-COMPONENT DEVELOPER REGULATING MEMBER FOR ELECTRO PHOTOGRAPHIC DEVICE

BACKGROUND OF THE INVENTION

1. Field of the Invention

The present invention relates to a one-component developing device used for an electrophotographic apparatus, such as a copier or a printer, and relates in particular to a one-component developing device which uses a one-component developer.

2. Related Arts

Currently, electrophotographic apparatuses are employed as copiers or printers. Such an electrophotographic apparatus forms an electrostatic latent image on a photosensitive drum, and then develops the latent image, a task for which a developing device is required. In general, two types of devices are employed for this purpose: a two-component developing device and a one-component developing device, which respectively use a two-component developer and a one-component developer. Of the two devices, the one-component developing device is the least complicated to make and the one can be constructed the most compactly. But when a one-component developing device is used, the layer of developer with which a developing roller is coated must have a uniform thickness.

FIG. 11 is a diagram showing a conventional developing device.

As is shown in FIG. 11, an electrostatic latent image is formed on a latent image bearing member 90, such as a photosensitive drum, and the latent image on the latent image bearing member 90 is then developed using a one-component developing device 91. The components comprising a one-component developing device 91 include a developing roller (developer carrier) 92, a feed roller (developer feeding member) 94, and a regulating blade (developer regulating member) 93.

In the development process, a one-component developer 95 is used to uniformly coat the developing roller 92, which then transports the developer 95 to a developing area, facing the photosensitive drum 90, where in response to the application to the developing roller 92 of a bias voltage (a DC or an AC voltage), developer 95 is transferred to the photosensitive drum 90. For this process, the feed roller 94 supplies the developer 95 to the developing roller 92, and the regulating blade 93, which is formed of a stainless steel leaf-spring, smooths and levels the developer 95 on the developing roller 92.

In a conventional developing device, a uniform thickness is maintained for the coating of the developer 95, which is supplied to the developing roller 92 by the feed roller 94, by the regulating blade 93. And the developing roller 92 is rotated so that it transports the developer 95 to the developing area for the photosensitive drum 90.

The arrangement of a one-component developing device can be simplified. In such a device, the regulating blade 93 is formed of a leaf-spring, which at one end is fixed to the frame of the developing device and at the other end is free. With this arrangement, based on the support provided by its fixed end, the regulation blade 93 is pressed against the developing roller 92 by the force developed by the leaf-spring and maintains on the developing roller 92 a developer 95 layer having a constant thickness. Accordingly, the blade 93 linearly contacts the developing roller 92.

However, the conventional developing device has the following problems.

First, in order to increase the quantity of available developer 95, the amount supplied must be sufficient to fill the space behind the regulating blade 93. For especially when a developing unit is supplied as an exchangeable cartridge, if a large quantity of developer 95 is loaded into the cartridge the replacement period can be extended, and running costs can be reduced. However, because under the circumstances the developer 95 is stored to the rear of the leaf spring regulating blade 93, the pressing force exerted by the blade will vary in accordance with the amount of developer 95 remaining in the cartridge. In other words, when there is a large amount of developer 95 available to the rear of the regulating blade 93, the force with which the regulating blade 93 presses against the developing roller 92 is comparatively strong; but as the supply of developer 95 is depleted, there is a corresponding reduction in the pressing force exerted by the regulating blade 93.

Therefore, the thickness of the developer layer on the developing roller 92 varies, and image density is accordingly changed. To prevent this, the maximum volume of the developer must be reduced so that undue pressure is not applied to the regulating blade 93; however, when the maximum volume for the developer is reduced, the replacement period is shortened. And although the size of the developer unit may be increased so it contains more developer, such an increase will result in a like increase in the size of a printer itself.

Second, when a large amount of developer 95 is supplied, in addition to influencing the pressing force exerted by the regulating blade 93, the developer 95 tends to compact and to form solid masses which thereafter are attached to the regulating blade 93. As a result, the thickness of the developer 95 applied to the developing roller 92 is not uniform, and lines and stripes appear on a developed image.

SUMMARY OF THE INVENTION

It is, therefore, one objective of the present invention to provide a one-component developing device which reduces changes in image densities.

It is another objective of the present invention to provide a one-component developing device wherefor image density is not affected by the amount of developer.

It is an additional objective of the present invention to provide a one-component developing device which prevents image failures, such as the printing of lines and stripes.

To achieve these objectives, according to one aspect of the present invention, a one-component developing device comprises: a developer carrier for feeding a one-component developer to an image bearing member; and a developer regulating member for regulating a thickness of a developer layer on the developer carrier. The developer regulating member includes a blade, for regulating the thickness of the developer layer on the developer carrier, and a blade table, for supporting both ends of the blade and for achieving face-contact between the blade and the developer carrier.

Since the blade table supports the blade at either end, the blade is bent when it is pushed against the developer carrier and face-contact with the developer carrier is achieved. Therefore, the force with which the blade contacts the developer carrier is dispersed. As a result, the developer is not contacted and attached as solid masses to the blade or the developer carrier, and the generation of lines and stripes can be prevented.

Further, the developer contained in a developing unit does not contact the blade table and thereby apply no pressure to the blade. Thus, the pressure applied to the blade is not changed, and accordingly, the image density is not varied.

According to one more aspect of the present invention, the blade and the blade table do not contact each other in an area whereat the blade contacts the developer carrier.

In this case, the blade table can be formed so that a gap is defined between the blade and the blade table in that area whereat the blade contacts the developer carrier.

According to another aspect of the present invention, one end of the blade is fixed to the blade table, and a projection on the blade table supports the other end of the blade.

The end of the blade farthest from the developer carrier is fixed to the blade table, while the other end of the blade, which is closest to the developer carrier, is supported by the blade table.

The end of the blade closest to the developer carrier is not fixed to the blade table.

According to an additional aspect of the present invention, the portion of the blade table which supports the other end of the blade is formed of a flexible member.

According to a further aspect of the present invention, the blade table supports the other end of the blade, and has a projection formed of a flexible member.

According to a further aspect of the present invention, a bending portion is formed at the other end of the blade, and the blade supports the bending portion of the blade.

According to yet one more aspect of the present invention, a flexible member for pressing the blade against the developer carrier is provided between the blade and the blade table.

According to yet another aspect of the present invention, the blade table includes a first portion, to which one end of the blade is fixed, a second portion, which supports the other end of the blade, and a third portion, which is provided between the first and the second portions and does not contact the blade.

According to yet an additional aspect of the present invention, the blade table is formed with an integral support member.

According to yet one further aspect of the present invention, means for applying a DC or AC voltage is provided between the developer carrier and the image bearing member.

DETAILED DESCRIPTION OF THE PREFERRED EMBODIMENTS

Figure 1:
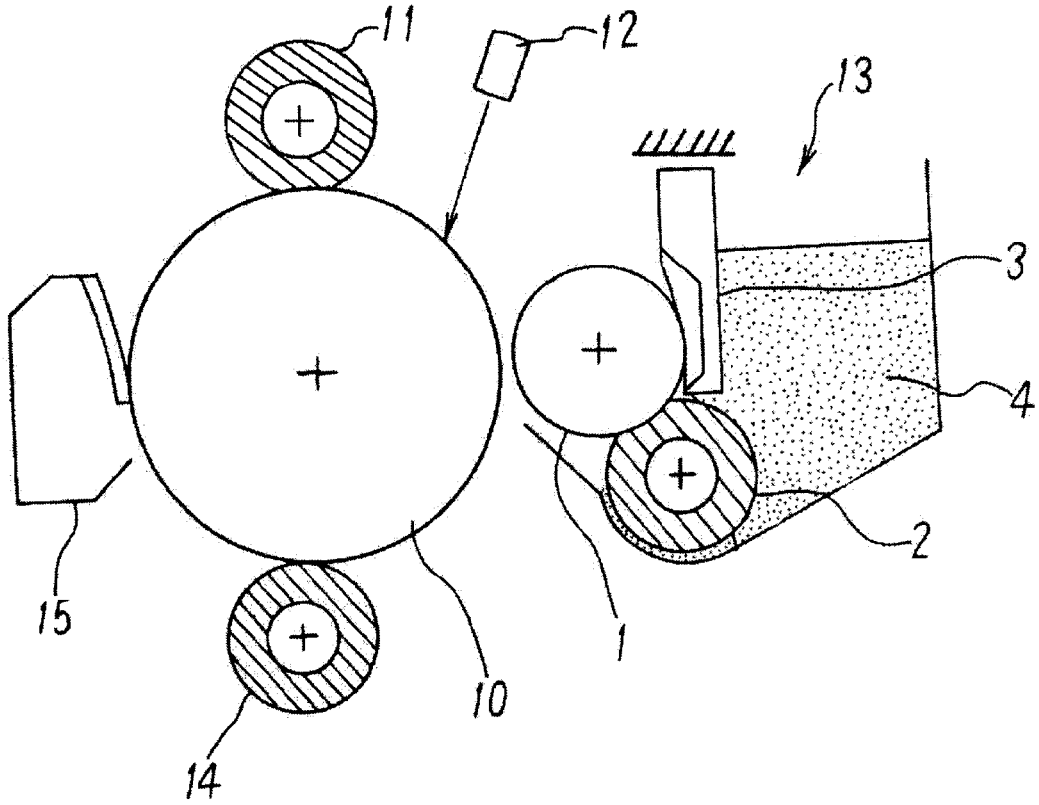
FIG. 1 is a diagram illustrating the arrangement of an electrophotographic apparatus according to the present invention.
Figure 2:
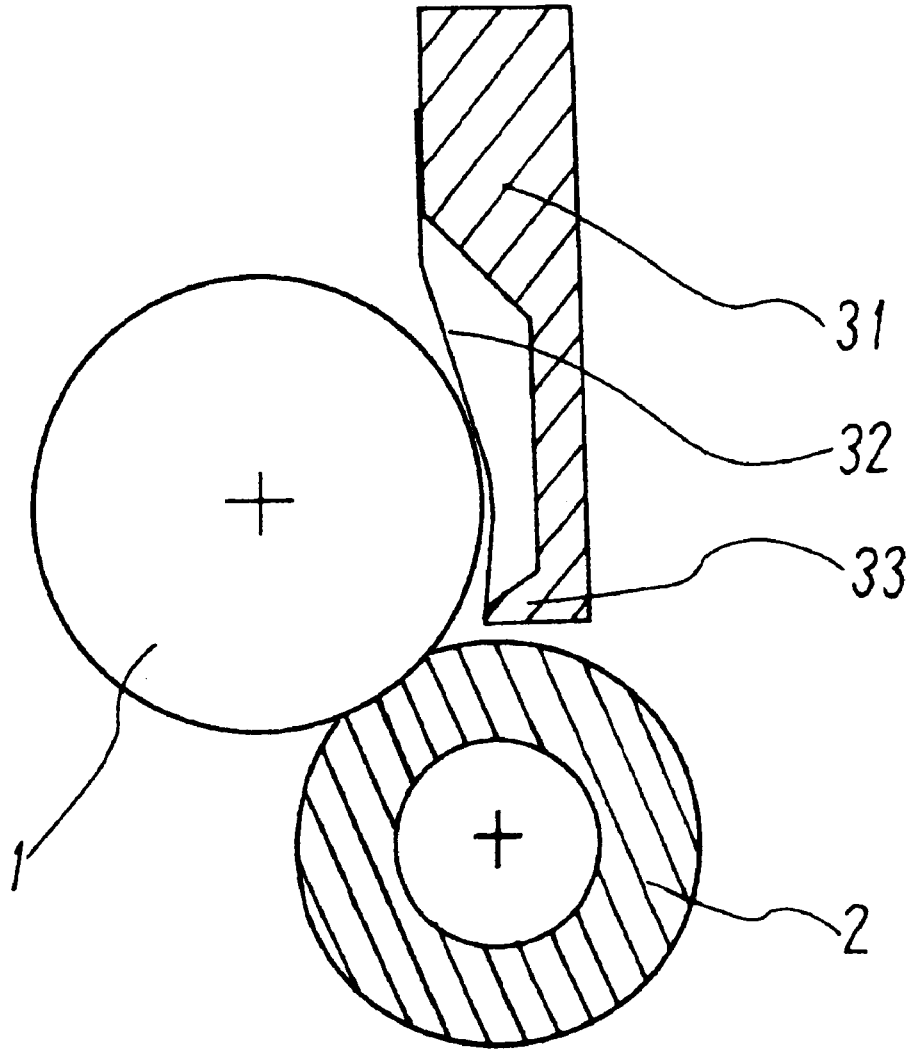
FIG. 2 is a diagram showing an arrangement for a first embodiment of the present invention.
Figure 3:
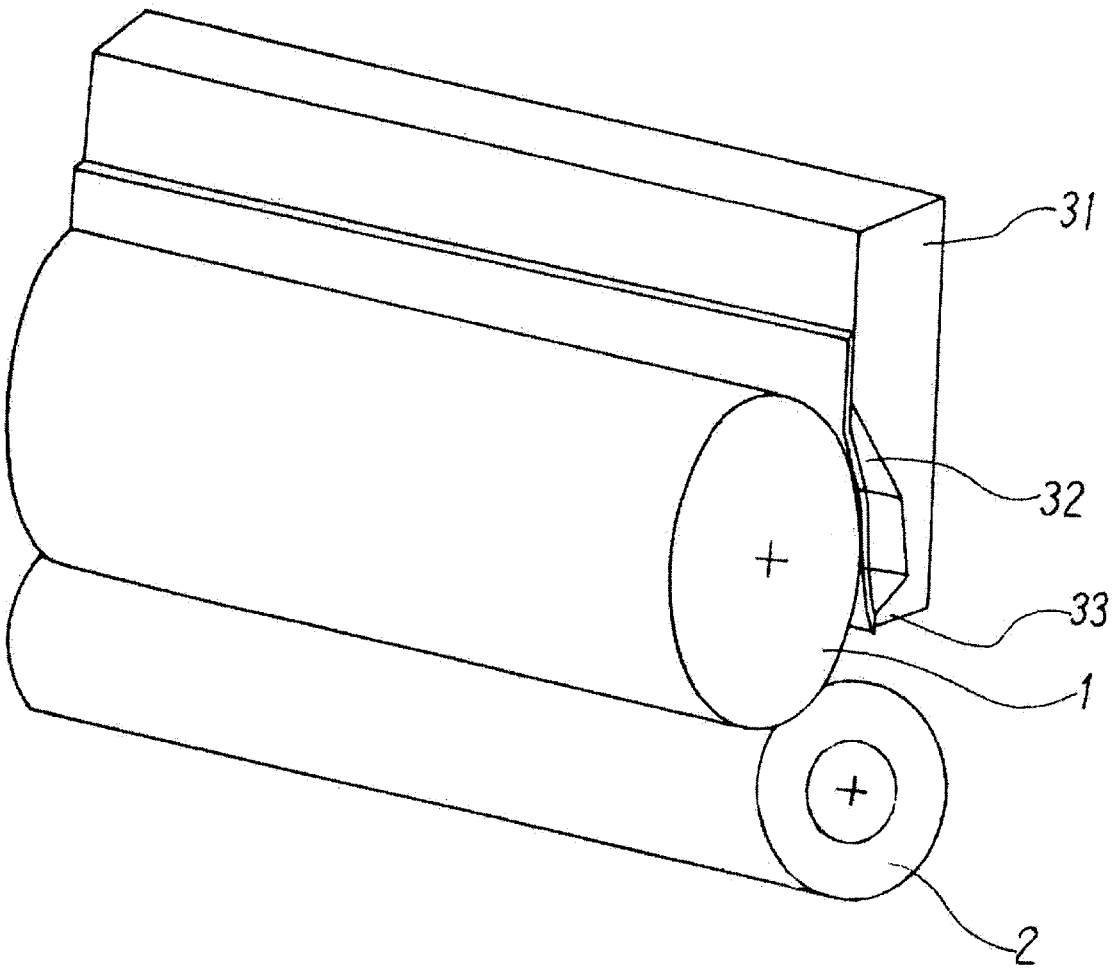
FIG. 3 is a perspective view of the arrangement in FIG. 2.

FIG. 1 is a diagram illustrating the arrangement of an electrophotographic apparatus according to the present invention. FIG. 2 is a diagram showing a developing device in FIG. 1 according to a first embodiment; and FIG. 3 is a perspective view of the device.

A latent image bearing member 10 is a photosensitive drum, such as an OPC. A pre-charger 11 charges the photoconductive drum 10 by applying a voltage to eelectroconductive members, such as a electroconductive brush and an electroconductive roller. And the pre-charger 11 may be used a corona charger. Then, in accordance with an image pattern, an exposure unit 12, which can be a laser scanning optical system or an LED array, exposes the photosensitive drum 10 and forms an electrostatic latent image thereon.

A one-component developing device 13, which is positioned opposite, but does not contact, the photosensitive drum 10, employs a one-component developer to develop the electrostatic latent image on the photosensitive drum 10. The one-component developing device 13 includes a developer carrier (developing roller) 1, a developer feeding member (feed roller) 2, a developer regulating member (regulating blade) 3 and a one-component developer (non-magnetic toner) 4.

A transfer unit 14 has an electroconductive elastic member (sponge or rubber) to which a transfer bias voltage is applied. The transfer unit 14, which may be a corona discharger, transfers to a recording medium a toner image formed on the photosensitive drum 10.

A cleaning member 15 removes residual toner adhering to the photosensitive drum 10 after a toner image has been transferred. For this procedure, a rubber blade, which is pressed against the photosensitive drum 10, is used to remove the developer from the photosensitive drum 10. Another cleaning member, such as a cleaning brush, may also be employed.

As is shown in FIGS. 2 and 3, the developer carrier 1 is a developing roller which is uniformly coated with the one component developer 4. The developing roller 1 transports the developer 4 to the developing area opposite the photosensitive drum 10, and upon the application of a bias voltage (a DC or an AC voltage) (not shown) uses the developer 4 to develop the image on the photosensitive drum 10.

For the application of a DC voltage, a roller covered with electroconductive rubber, or a roller having a rubber surface which is coated with resin is employed as the developing roller 1 and is brought into contact with the photosensitive drum 10. For the application of an AC voltage, the developing roller 1 is constructed of a metal, such as aluminum or stainless steel, and is so positioned that there is a predetermined gap between it and the photosensitive drum 10.

The developing roller 1 has a surface roughness Rz of 2 to 10 $\mu$m, which provides an enhanced transportation capability for the developer 4.

While the width of the developing roller 1 varies, depending on the printable sheet size for a specific apparatus, in each instance the width is slightly greater than that of the largest printable sheet size.

The developer feeding member 2 is a feed roller for transferring developer 4 to the developing roller 1. As the developer 4 is rubbed against the developing roller 1 by the feed roller 2, it is charged by the teed roller 2 and is transferred to the developing roller 1. For these purposes, it is preferable that the feed roller 2 be constructed of an electroconductive flexible or foam material, such as electroconductive urethan sponge or silicone sponge. The feed roller 2 also removes excess developer 4 adhering to the developing roller 1.

The developer regulating member 3 is used to evenly distribute the developer 4 across the developing roller 1. For this purpose, the developer regulating member 3 includes a blade table 31, a blade 32 and a projection 33, which is an integral part of the blade table 31.

The blade table 31 supports the blade 32 at a predetermined position, and prevents pressure produced by the developer 4 from being applied to the rear of the blade 32. The blade table 31 has a rigid body which is constructed of a material such as aluminum or stainless steel, or of a resin, such as ABS or PS.

The blade table 31 is attached to the frame of the developing device, either integrally or by screws, so that the gap with the developing roller 1 can be adjusted. Regardless of which method is used, the blade table 31 is so secured to the developing device that it can not be moved by the pressure produced by the developer 4 stored in the developing device.

The blade 32, which is held against the developing roller 1 by the application of a constant predetermined pressure, is used to thin out the layer of developer 4 applied to the developing roller 1. The blade 32 is made of a leaf spring material, such as stainless steel or phosphor bronze, or of another flexible material, such as resin.

When the blade 32 is pressed against the developing roller 1, the projection 33 prevents the blade 32 from contacting the blade table 31. While in this embodiment the projection 33 is formed as an integral part of the blade table 31, it may also be formed as a separate component.

The developer 4 is a non-magnetic developer which is produced by mixing a charge control agent and a coloring agent with a base material, such as polyester, acrylstyrene or epoxy, and by subsequently pulverizing the obtained material and adding silica, etc., to the pulverized material. This process produces particles having an average size ranging from 6 to 12 $\mu$m. In addition, toner manufactured using a polymerization method may be employed.

The operation performed by the arrangement in FIG. 1 will now be described. A charge having a predetermined voltage, e.g., −600 V to −700, is placed on the photosensitive drum 10 by the pre-charger 11. Then, in accordance with an image signal, the exposure unit 12 exposes and forms an electrostatic latent image on the photosensitive drum 10. Following this, the one-component developing device 13 develops the latent image on the photosensitive drum 10 by attaching developer 4 to it. Subsequently, the transfer unit 14 transfers the developed image to a recording medium to which it is thereafter fixed by a fixing unit (not shown). Finally, any developer 4 remaining on the photosensitive drum 10 is removed by the cleaning member 15.

In the embodiment of the one-component developing device 13, spot welding is used to fix the upper end (one end) of the blade 32 to the upper portion (a first portion) of the blade table 31, while the other end of the blade 32 is simply supported by the projection (a third portion) 33 of the blade table 31 and is not fixed to it.

With this arrangement, both ends of the blade 32 are supported by the blade table 31, and the center of the blade 32 does not contact the blade table 31 (a second portion), i.e., a gap is defined between the center of the blade 32 and the blade table 31. Therefore, when the blade 32 is pressed against the developing roller 1, it bends and face-contact between it and the face of the developing roller 1 is achieved.

As a result, the pressure which is developed between the blade 32 and the developing roller 1 and is exerted against on the developer 4 is dispersed, so that the developer 4 does not solidify and firmly attach itself to the blade 32 and the developing roller 1. As a result, the generation of lines and stripes can be prevented.

Since the blade 32 is supported by the blade table 31, the developer stored in the developing device exerts no pressure on the blade 32. Thus, the pressure applied by the blade 32 does not change in accordance with the volume of the available developer, and changes in image density can be prevented.

In the embodiment, one of the ends of the blade 32 is not fixed to the projection 33. And as a result, even when the blade 32 exhibits a strong leaf spring characteristic, it can bend and assume the shape of the developing roller 1. In addition, if the blade 32 is composed of a very flexible material, the unsecured end of the blade 32 can be fixed to the projection 33.

Figure 11:
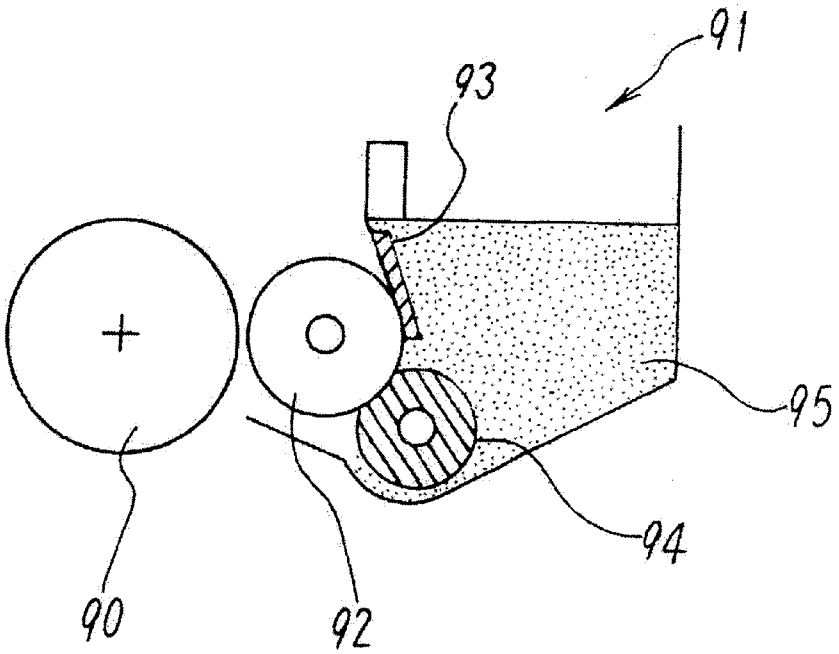
FIG. 11 Prior Art
FIG. 11 is a diagram for explaining a conventional developing device.

A first embodiment of the present invention will now be described. A sand-blasted aluminum roller having a surface roughness Rz of 5 $\mu$m was employed as the developing roller 1, and as the regulating blade in FIG. 11, a regulating blade 93 was used for which a stainless steel spring material (SUS304CSP) having a thickness of 0.1 mm was employed. A line pressure of 40 g/cm was applied to press the regulating blade 93 against the developing roller 1, and a toner was supplied which had a melting point of 110° C. A blank test was then conducted for the conventionally arranged developing device, and as a result, five hours later it was found that toner layer lines had appeared on the developing roller 1.

In contrast, when the regulating blade 3 in FIG. 2, which was constructed of a stainless steel spring material having a thickness of 0.5 mm, was used for the regulating blade 32, and a line pressure of 40 g/cm was employed to press the blade 32 against the developing roller 1, as a result of a blank test which was conducted, even after ten hours had elapsed it was found that no toner layer lines had appeared on the developing roller 1.

A 5% printing test of 5000 sheets was then conducted for a conventional developing device. As a result, it was found that the initial image density was 1.3, but that after 5000 sheets had been printed, the image density had risen to 1.4. This meant that as printing continued and the volume of the developer in the developing device was reduced, accordingly, the force exerted on the regulating blade 93 was likewise reduced. But when a developing device was used which was arranged in accordance with the embodiment, after 5000 sheets had been printed an initial image density of 1.35 had risen only to 1.36. Substantially, there was no difference in the image density.

The other embodiments will now be explained while referring to FIGS. 4 to 10.

Figure 4:
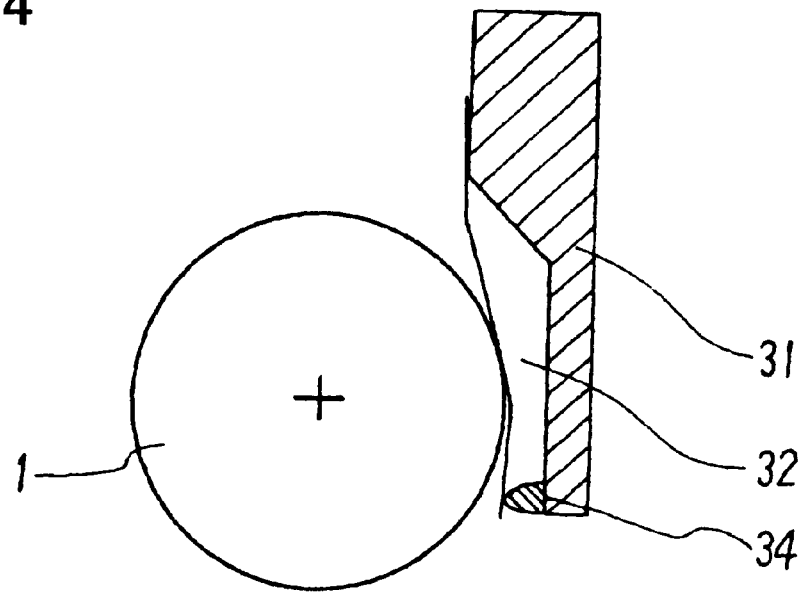
FIG. 4 is a diagram showing an arrangement for a second embodiment of the present invention.

FIG. 4 is a diagram showing the arrangement for a second embodiment of the present invention.

In FIG. 4 the same reference numerals used in FIG. 2 are used to denote corresponding or identical components. A projection 34, an elastic member (rubber or sponge) which is formed separate from the blade table 31, is located at the lower end of the blade table 31, where it supports the lower end of the blade 32.

In this embodiment, since the projection 34, an elastic member, is provided for the blade 32, the positioning of the blade 32 relative to the projection 34 is improved, and there is no gap between them. Thus, developer can be prevented from entering the space between the blade 32 and the blade table 31 through a gap formed by the projection 32 and the blade 32. The projection 34 may be provided for the blade 32.

Figure 5:
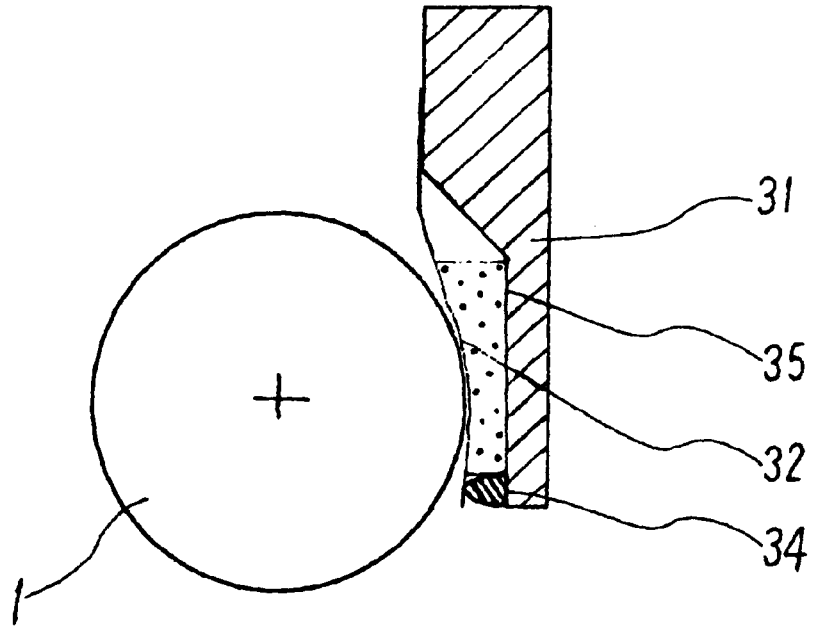
FIG. 5 is a diagram showing an arrangement for a third embodiment of the present invention.

FIG. 5 is a diagram showing an arrangement for a third embodiment of the present invention.

The same reference numerals used in FIGS. 2 and 4 are used in FIG. 5 to denote corresponding or identical component, and an elastic member 35, which is formed in the space between the blade 32 and the blade table 31, is composed of a material, such as sponge or rubber. When the pressing force produced by the elastic member 35 is applied to the blade 32, the spring force required of the blade 32 can be reduced. That is, the area whereat the blade 32 contacts the developing roller 1 is increased. As a result, a smaller force is required to press the blade 32 against the developing roller 1, and the solidification and attachment of the developer can more effectively be prevented.

Figure 6:
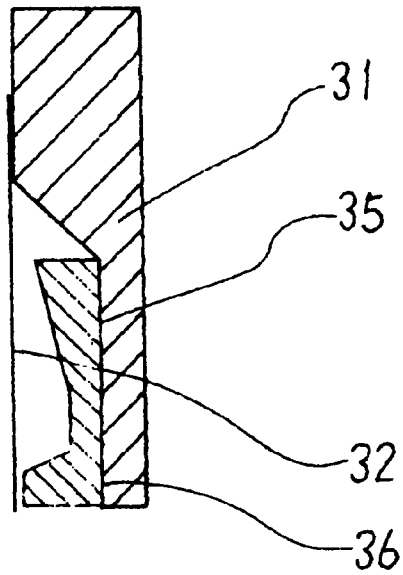
FIG. 6 is a diagram showing an arrangement for a fourth embodiment of the present invention.

FIG. 6 is a diagram showing the arrangement of a fourth embodiment of the present invention.

The same reference numerals as are used in FIG. 5 are used in FIG. 6 to denote corresponding or identical components. A projection 36 is formed at the lower end of an elastic member 35, which is provided for the blade table 31. In this embodiment, unlike the fifth embodiment, the projection 36 is integrally formed with the elastic member 35. Therefore, as in FIG. 5, when the elastic member 35 applies a pressing force to the blade 32, the spring force which is required of the blade 32 can be reduced. That is, the area whereat the blade 32 contacts the developing roller 1 is increased. And only a smaller pressing force is required to push the blade 32 against the developing roller 1. Further, since the elastic member 35 and the projection 36 are integrally formed, the number of required parts can be reduced.

Figure 7:
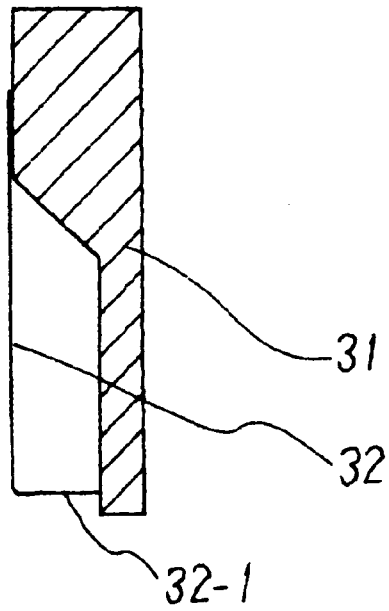
FIG. 7 is a diagram showing an arrangement for a fifth embodiment of the present invention.

FIG. 7 is a diagram showing the arrangement of a fifth embodiment of the present invention.

The same reference numerals as are used in FIGS. 2 and 4 are used in FIG. 7 to denote corresponding or identical components. A bending portion 32-1 is formed at the lower end of the blade 32, and is supported at the lower end of the blade table 31. In this embodiment, when compared with the arrangement in FIG. 4, the projection is formed as a bending portion. In addition to obtaining the same effects as those provided by the arrangement in FIG. 4, the number of required parts can be reduced.

Figure 8:
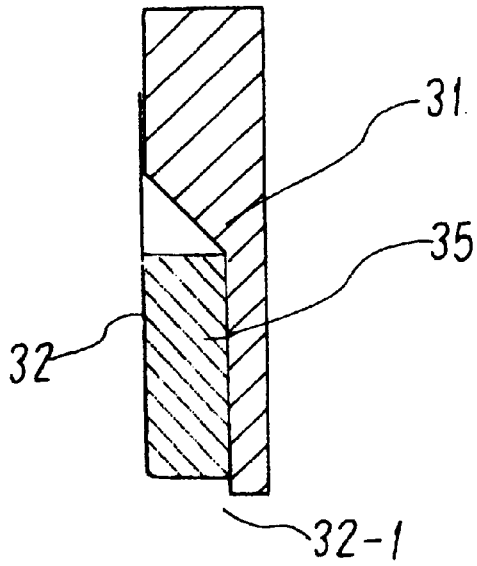
FIG. 8 is a diagram showing an arrangement for a sixth embodiment of the present invention.

FIG. 8 is a diagram showing the arrangement for a sixth embodiment of the present invention.

The same reference numerals as are used in FIG. 5 are used to denote corresponding or identical components. A bending portion 32-1 is formed at the lower end of the blade 32, which is thereat supported by the blade table 31. An elastic member 35 which is comparable to the elastic member 35 in FIG. 5 and which in this embodiment is additionally provided for the arrangement in FIG. 7, is positioned in a gap between the blade 32 and the blade table 31. Thus, both the effects obtained by the arrangement in FIG. 7 and those obtained by the arrangement in FIG. 5 are acquired. And in addition, the number of required parts can be reduced.

Figure 9:
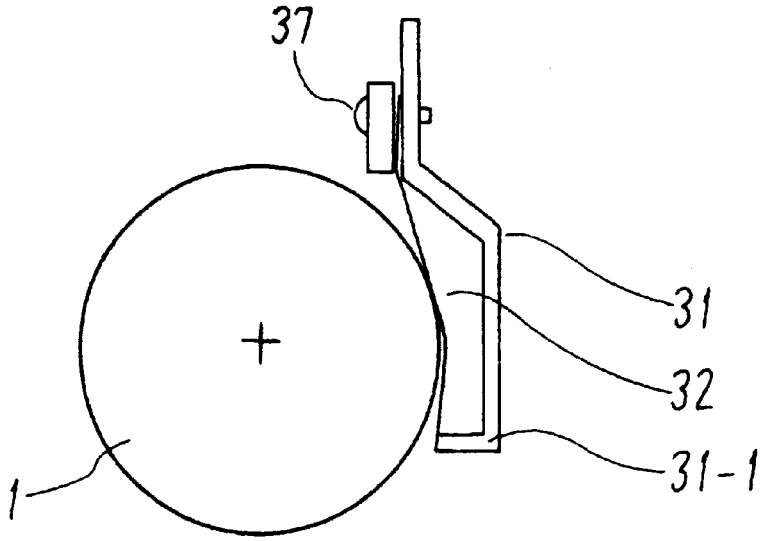
FIG. 9 is a diagram showing an arrangement for a seventh embodiment of the present invention.

FIG. 9 is a diagram showing the arrangement for a seventh embodiment of the present invention.

The same reference numerals as are used in FIG. 2 are used in FIG. 9 to denote corresponding or identical components. The blade table 31 is made from a plate, such as a stainless steel plate, by pressing. That is, a plate is shaped in a press to provide a first portion to which a blade 32 is attached, a second portion which the blade 32 does not contact, and a third portion 31-1 which supports the blade 32. A screw 37 and a presser plate are used to fix the blade 32 to the blade table 31.

In this embodiment, a blade table 31 manufactured on a press can provide the same effects as are obtained in FIG. 2. Spot welding may be also be used to secure the blade 32 to the blade table 31.

Figure 10:
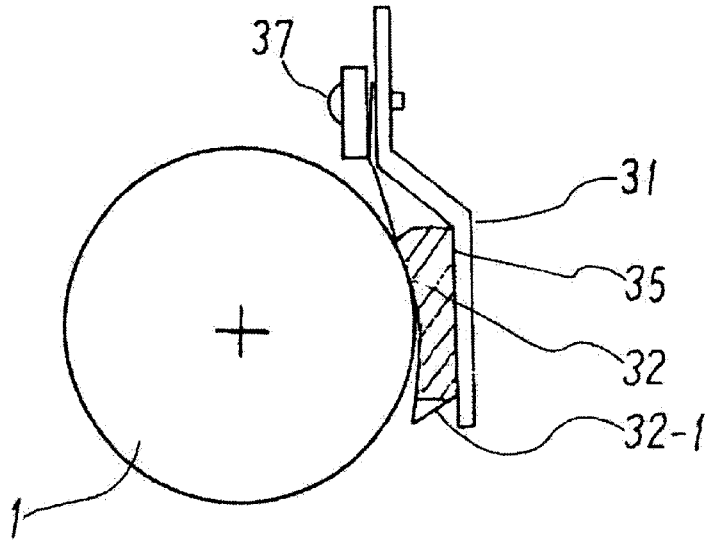
FIG. 10 is a diagram showing an arrangement for an eighth embodiment of the present invention.

FIG. 10 is a diagram showing the arrangement for an eighth embodiment of the present invention.

The same reference numerals as are used in FIG. 8 are used in FIG. 10 to denote corresponding or identical components. The blade table 31 is made from a plate, such as a stainless steel plate, by pressing. That is, a plate is shaped in a press to provide a first portion to which the blade 32 is attached, and a second portion which the blade does not contact. A screw and a presser plate are used to fix the blade 32 to the blade table 31, and an elastic member 35 is provided in the gap between the blade 32 and the blade table 31. A flexible portion 32-1, which is formed at the lower end of the blade 32, is supported by the lower end of the blade table 31.

In this embodiment, a blade table 31 manufactured on a press can provide the same effects as are obtained in FIG. 7. Spot welding may also be employed to secure the blade 32 to the blade table 31.

In addition to these embodiments, the present invention can be modified as follows.

(1) In the embodiments, an electrophotographic apparatus having an exposure means has been employed as an image forming apparatus. However, the present invention can be applied for an image forming apparatus which forms an electrostatic latent image using a different exposure means.

(2) In the embodiments, the developer carrier which is described is a roller. However, a developer carrier having a different shape can be employed.

The present invention has been described using the embodiments. However, the present invention can be variously modified without departing from the subject of the invention, and these modifications are also included in the scope of the present invention.

As is described above, according to the present invention, the following effects are obtained.

(1) Since the blade table supports both ends of the blade, the blade bends when it is pressed against the developer carrier, and face-contact is achieved between the blade and the face of developer carrier. Therefore, the force which the developer carrier and the blade exert on the developer is dispersed, and the developer does not become solidified and attach itself to the blade and the developer carrier. As a result, the generation of lines and stripes can be prevented.

(2) Further, since a large area of the developing roller is contacted by the blade, the capacity for charging toner between the two devices is also improved.

(3) The developer stored in the developing device does not contact the blade and exert pressure on it, and thus, the pressure applied by of the blade is not varied and there is no change in the image density.

What is claimed is:

1. A one-component developing device comprising:

a developer carrier for feeding a one-component developer to an image bearing member; and a developer regulating member for regulating a thickness of a developer layer on said developer carrier, wherein said developer regulating member includes a blade for regulating the thickness of said developer layer on said developer carrier, and a blade table for supporting both ends of said blade and for achieving face-contact between said blade and said developer carrier, wherein said blade and said blade table do not contact each other in an area wherein said blade contacts said developer carrier.

2. A one-component developing device according to claim 1, wherein one end of said blade is fixed to said blade table, and a projection on said blade table supports the other end of said blade.

3. A one-component developing device according to claim 1, wherein a portion of said blade table which supports said other end of said blade is constituted by a flexible member.

4. A one-component developing device according to claim 3, wherein said blade table supports said other end of said blade, and has a projection formed of a flexible member.

5. A one-component developing device according to claim 1, wherein a bending portion is formed at said other end of said blade.

6. A one-component developing device according to claim 1, wherein a flexible member for pressing said blade against said developer carrier is provided between said blade and said blade table.

7. A one-component developing device according to claim 1, wherein said blade table includes a first portion, to which one end of said blade is fixed, a second portion, which supports the other end of said blade, and a third portion, which is provided between said first and said second portions and does not contact said blade.

8. A one-component developing device according to claim 7, wherein said blade table is formed with an integral support member.

9. A one-component developing device according to claim 1, wherein means for applying a DC or AC voltage is provided between said developer carrier and said image bearing member.

* * * * *